US006164356A

United States Patent [19]

Strohmeyer et al.

[11] Patent Number: 6,164,356

[45] Date of Patent: Dec. 26, 2000

[54] LOW PRESSURE ACTUATED LABELING APPARATUS

[75] Inventors: James J. Strohmeyer, Ballwin, Mo.; Donald C. Wright, Orlando; Ken Crossland, Winter Springs, both of Fla.

[73] Assignee: Systems & Electronics, Inc., St. Louis, Mo.

[21] Appl. No.: 09/153,614

[22] Filed: Sep. 15, 1998

[51] Int. Cl.[7] ..... B41J 29/00

[52] U.S. Cl. ..... 156/387; 156/517; 156/521; 156/256; 156/277; 283/67

[58] Field of Search ..... 156/517, 387, 156/256, 277, 521; 283/67, 81

[56] References Cited

U.S. PATENT DOCUMENTS 5,560,293 10/1996 Boreali et al. ..... 101/288

5,833,803 11/1998 Strohmeyer et al. ..... 156/517

*Primary Examiner*—Linda L. Gray

*Attorney, Agent, or Firm*—Polster, Lieder, Woodruff & Lucchesi, L.C.

[57] ABSTRACT

A low pressure actuated labeling apparatus (10) for printing, cutting, and applying labels (L) to articles (A). A printing unit (12) prints information on a label, the label being drawn from a roll (13) of continuous label stock. A cutting unit (14) cuts a printed label from an end of the roll with the cut label being deposited on a tamper unit (16) which transports the label to a position (P2) adjacent the article and affixes the label to the article. Guides (26, 28) guide the label between the printing and cutting units. One of the guides (26) includes a plate (102) having spaced slots (106*a*–106*c*) in which are installed guides (108,110,112). The guides each include guide arms which are contacted by an adhesive side (Y) of the label. However, the guides are made of a material to which the label will not adhere, thus insuring continued movement of the label.

4 Claims, 3 Drawing Sheets

LOW PRESSURE ACTUATED LABELING APPARATUS

CROSS-REFERENCE TO RELATED APPLICATIONS

U.S. patent application Ser. No. 08/759,785, filed Dec. 3, 1996, now U.S. Pat. No. 5,833,803.

BACKGROUND OF THE INVENTION

This invention relates to apparatus for printing, cutting, and applying labels to envelopes, packages, and other mail pieces or articles, and more particularly, to an improvement to such apparatus.

In U.S. patent application Ser. No. 08/759,785, U.S. Pat. No. 5,833,803, there is described apparatus for use by the postal service records in processing mail. The apparatus is used with linerless labels which are provided on a roll with one side of the label being printed on, and with the other side being coated with an adhesive backing material for affixing each label to a mail piece. The label is called linerless because there is no backing strip covering the adhesive backing on the labels that has to be peeled away before the label can be applied. The apparatus described in the above referenced application is advantageous in that it employs a high air volume, low pressure air source. Operation of the apparatus is such that an end label on a roll of labels is first printed, then cut off from the roll, transported from a first location to a second location, and then applied to a package, envelope, or other article at the second location. While designed primarily for use in postal service operations, the apparatus has other applications as well for printing labels of various types and applying them to different articles.

In addition to various problems previously addressed and overcome by the apparatus, this application addresses an additional problem which is label jamming. The sequence of operations of the labeling apparatus include first indexing a label through a printer section so the label can be printed. From the print head, the label is moved to a cutter where the end label is severed from the end of a roll, and carried from the cutter to the article and applied to the article. In conveying labels from the print head to the cutter, a pair of cable guides (an upper guide and a lower guide) are used. Heretofore, the upper label guide had a plasma coating which allowed the adhesive side of the label to move smoothly over the guide surface without sticking. Over time, the plasma coating wears off and labels do stick to the guide. This creates jams.

BRIEF SUMMARY OF THE INVENTION

Among the several objects of the present invention may be noted the provision of an improvement to a low air pressure actuated labeling apparatus. The improvement helps prevent jamming caused by the adhesive side of labels adhering to a guide by which the label is guided between a printer and a label cutter. The plasma coated guides previously used are now replaced with a guide plate and a plurality of spaced strips of spacer elements which are contacted by the adhesive side of a label as it is being transported, but to which the label does not adhere. The spacers, in turn, prevent the adhesive side of the label from coming into direct contact with the label guide. This prevents jamming. The spacers are affixed to the guide in a suitable manner and are replaceable if damaged or broken.

In accordance with the invention, generally stated, a low air pressure actuated labeling apparatus is used to print labels which are applied to envelopes, packages, parcels, and other articles. A continuous strip of linerless label material is moved past a printing unit at which predetermined information is printed on the label. Printing is done on a non-adhesive side of a label. The strip of material is then moved to a cutting station where the printed label is cut from the end of the roll. The cut label is deposited on the head of a tamper unit and transported from a location adjacent the cutting station to a location adjacent the article to which the label is applied. The label is then applied to the article. A label guide guides a printed label from the printing unit to the cutting station. The guide includes a plurality of spacers which are attached to the guide and which are made of a material to which the adhesive side of the label will not adhere. The spacers facilitate label movement and prevent jamming caused by labels sticking to the guide. Other articles and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
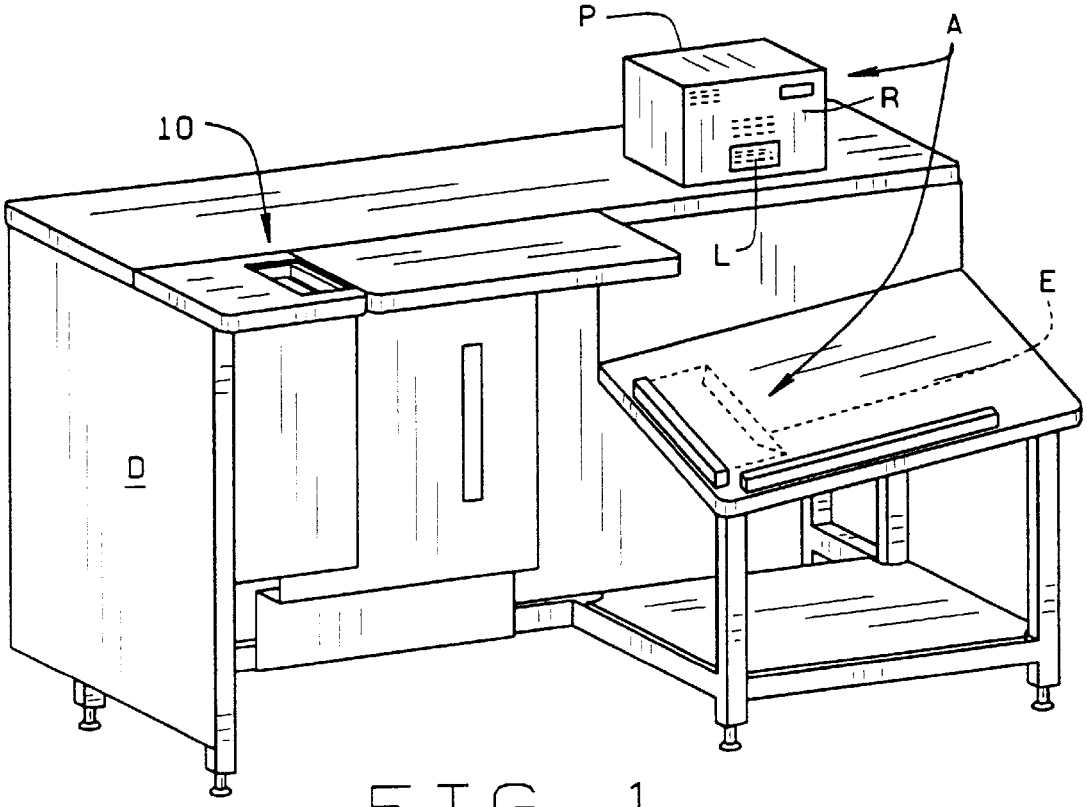
FIG. 1 is a perspective view of a desk in which the apparatus of the present invention is installed.
Figure 2A:
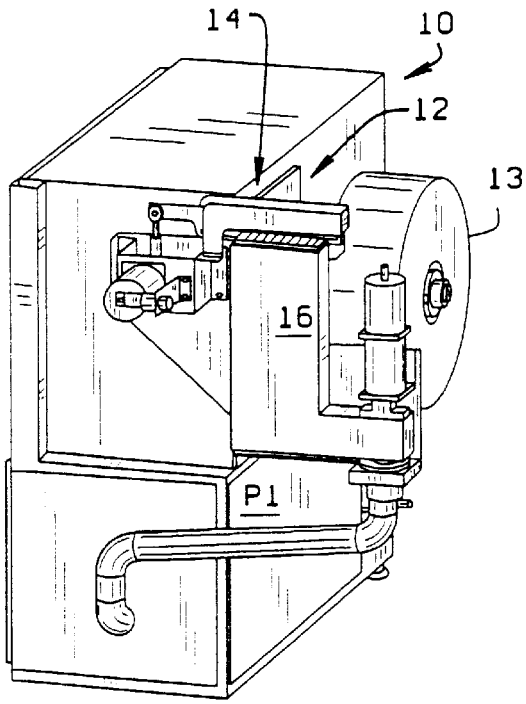
FIG. 2A is a perspective view of the apparatus of the invention in a first position in which a label is printed and cut from a strip of linerless label material.
Figure 2B:
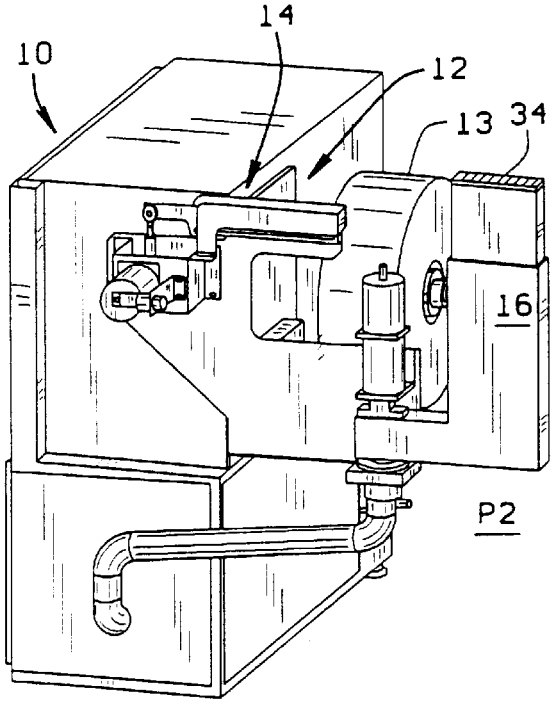
FIG. 2B is a similar view of the apparatus in which a tamper unit of the apparatus is moved to a position in which the label is affixed to a mail piece or other article.

Referring to the drawings, a low pressure actuated printing and labeling apparatus of the present invention is indicated generally 10 and is best shown in FIGS. 2A and 2B. In use, for example, the apparatus is installed in a labeling desk D shown in FIG. 1. A clerk sits at the desk and processes articles A such as mail pieces comprising envelopes E or packages or parcels P. The articles handled by the clerk are those which are addressed to a party who has moved from one address to another, so the articles need to be forwarded to the new address. The address R on the article is the old address and it is desired to conveniently forward the mail piece to the party at their new address. As described in U.S. patent application Ser. No. 08/759,785, U.S. Pat. No. 5,833,803, apparatus 10 automatically prints a label L which is then applied to the article. In addition to usage in mail handling applications, apparatus 10 has a variety of other applications for printing labels and applying them to articles.

Figure 4:
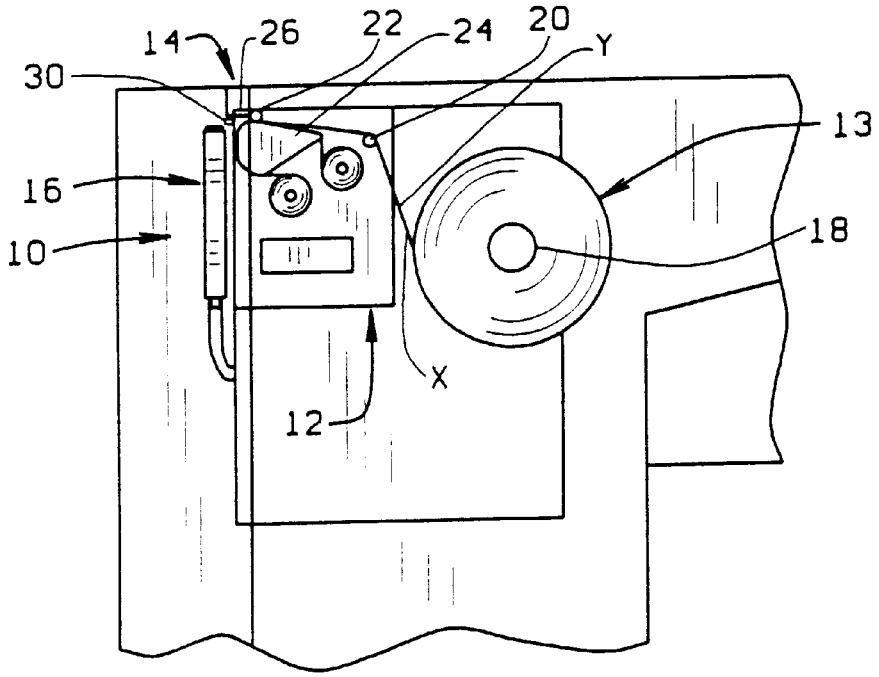
FIG. 4 is a front elevational view of the apparatus with the tamper unit in its position when a label is printed and cut.

Apparatus 10 includes a printer unit indicated generally 12 for printing a label from a roll 13 of continuous label stock. As shown in FIG. 4, one side of the label material is indicated X and has a surface upon which desired information can be printed by printer 12. The other side of the label is indicated Y and is coated or impregnated with an adhesive material by which printed and cut labels can be stuck onto articles such as the pieces of mail. The second component is a cutter unit 14 for cutting an individual label from the end of the continuous label stock after the label has been printed. The third component is a tamper unit 16 for transporting the cut label from a first position (P1 in the drawings) at which the label is deposited on the tamper unit after cutting, to a position P2 where the label is applied to an article.

Figure 3:
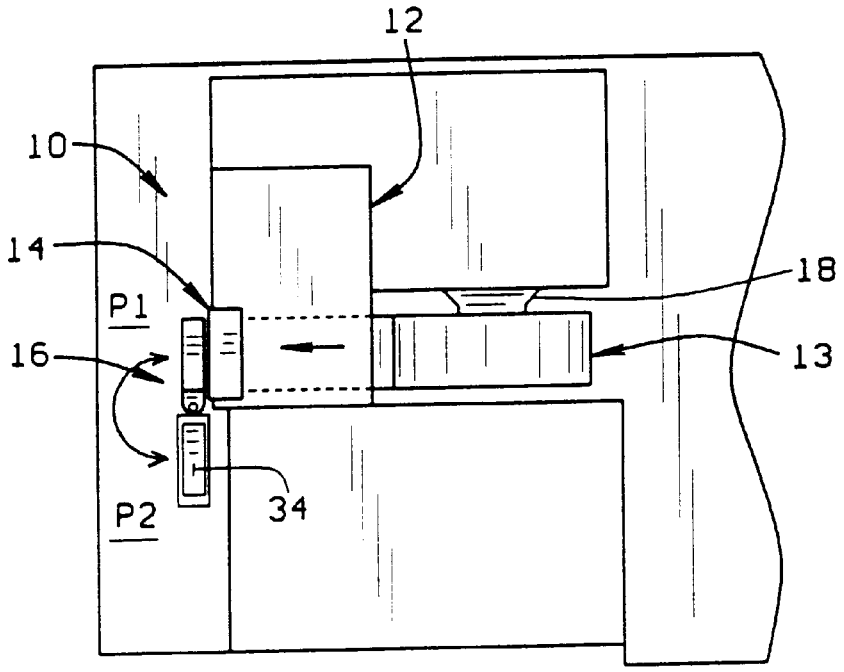
FIG. 3 is a top plan view of the apparatus illustrating the two positions of the tamper unit of the apparatus.

As shown in FIGS. 3 and 4, printer unit 12 first includes a label unwind including a post 18 on which a roll 13 of a continuous strip of labels is mounted. Next, the printer unit includes a post 20 and a roller 22 for unwinding the strip of labels off of the roll and over a printing head 24 of the printer. To prevent label material from sticking to roller 22 and causing jams, the roller 22 is preferably a silicon rubber coated roller. The printer is a commercially available thermal printer with which the label material is drawn to the printing head with the non-adhesive side X of the material facing the printing head. The printer accepts label material of different widths and print information on an area (footprint) which is adjustable depending upon the particular application with which the apparatus is used. In operation, printer 12 is responsible for drawing label material from the label roll, printing the desired information on the label material, and feeding the material forward a predetermined distance to the cutter.

Figure 5:
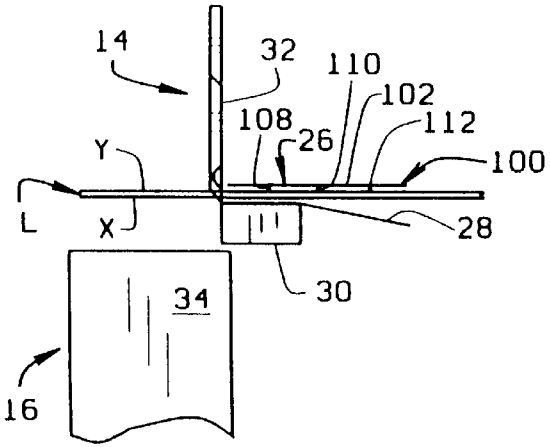
FIG. 5 is a front elevational view of a cutting assembly of the apparatus and a portion of the tamper unit showing the position of the assembly before a label is cut.
Figure 6:
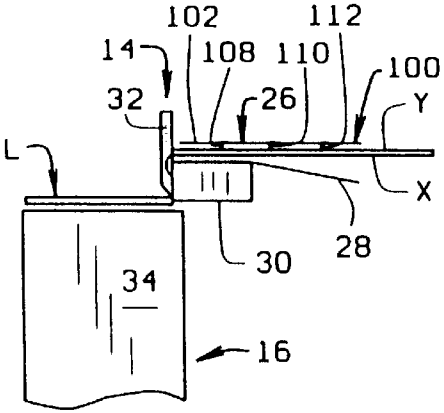
FIG. 6 is a view similar to FIG. 5 after a label is cut.

After printing a label, the end of the roll of label material is moved forwardly to the cutter unit. Cutter unit 14 accepts the printed label material from printer 12, cuts the material to a predetermined length, and places the cut label on tamper unit 16. As shown in FIGS. 5 and 6, the cutter unit includes respective top and bottom label guides 26, 28 to direct the label material from printer 12 over an anvil 30. Previously, top label guide 26 had a non-stick plasma coating to prevent adhesive side Y of the label from sticking to the guide. However, as previously noted, the plasma coating tends to wear off with use of the apparatus. This resulted in the adhesive side Y of the labels adhering to the guide and jamming the apparatus. Guide 26, constructed so as to facilitate label movement between the printing and cutting units and prevent jams, is described hereinafter. As shown in FIG. 5, after a label advances a predetermined distance so the printed portion of the label extends beyond the anvil, label advance is halted. As shown in FIG. 6, a sharpened blade 32 is now brought down across the anvil to cut the label material and sever the end label from the roll. A vacuum is now drawn on a head 34 of the tamper to hold and maintain the label on the tamper unit (adhesive side up) during transport. At position P2, the head is extended to press the adhesive side of the label against the article.

Figure 7A:
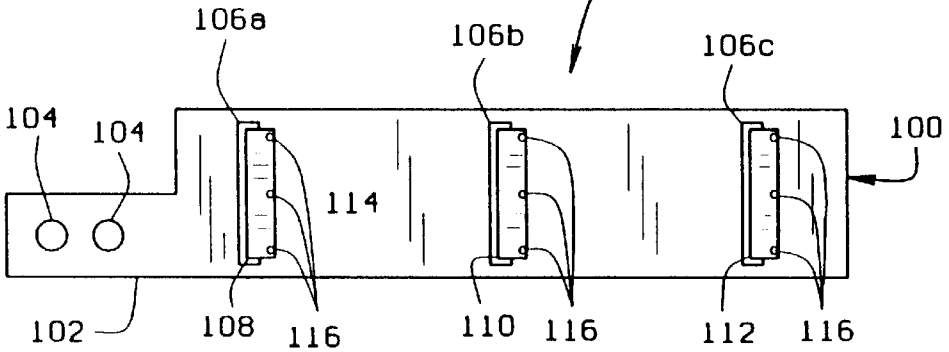
FIGS. 7A–7C are respective top plan, side elevational, and bottom plan views of a label guide of the apparatus for guiding labels between the printing unit and cutting unit.
Figure 7B:
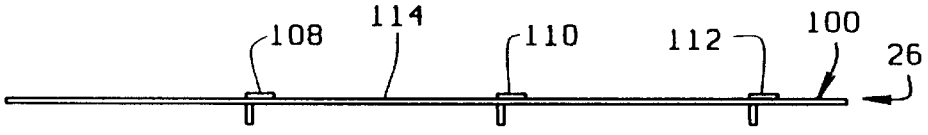
Figure 7C:
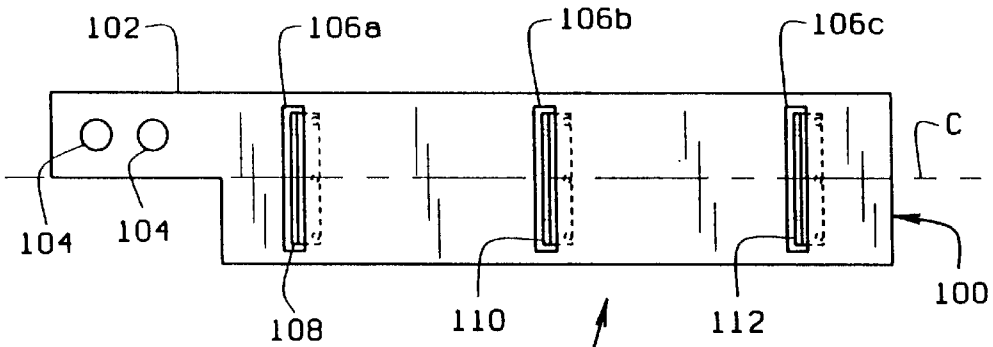

Referring to FIGS. 7A–7C, top guide 26 is shown to include a thin, flat plate 100 which has a section 102 of reduced width at one end. Axially aligned holes 104 are formed in end section 102 for mounting guide 26 in place using screws or other fasteners (not shown). Three spaced slots 106*a*–106*c* are formed in the wider portion of the plate. These slots are rectangular slots whose longer dimension is orthogonal to a longitudinal centerline C of the plate. The slots are centered about this axis. Mounted on plate 100 are three TEFLON guide strips 108, 110, and 100. Each guide strip is generally L-shaped having a base section and a guide section. The guide section of each strip is inserted through one of the slots, and the base section for the strip overlays a portion of the upper surface 114 of plate 100 adjacent the slot. The base section is secured to plate 102 by fasteners 116 such as rivets, for example. The guide portions of each strip each extend the same distance d beneath plate 100. Now, as the label material moves beneath the printing and cutting units, the adhesive side of the labels slide beneath the lower end of the depending guide arms. The labels extend parallel to the guide 26 and hence the plate which is spaced apart from the labels. It has been found that the guide arms do not wear in the same manner as the previous guides 26; but rather, allows the adhesive side of the label material to readily traverse the length of the guide without sticking and causing a jam.

What has been described is an improvement to a low pressure actuated labeling apparatus whose operation is such that an end label on a roll of linerless labels is first printed, then cut off from the roll, transported from a first location to a second location, and then applied to a package, envelope, or other article at the second location. The improvement includes a top label guide employing spaced TEFLON guide strips secured to a plate portion of the guide. The strips each have a depending guide arm beneath which the adhesive side of the labels slide without sticking and creating a jam.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A low pressure actuated labeling apparatus for printing, cutting, and applying labels to articles, the apparatus including a printing unit printing information on a label, the label being on a roll of continuous label stock with each label having a print side on which the information is printed and an adhesive side by which the printed label is applied to an article, and a cutting unit for cutting the printed label from an end of the roll of stock, the improvement comprising, first and second guides for guiding said label between said printing unit and said cutting unit, said printed side of said label contacting said first guide, and said adhesive side of said label contacting said second guide, said second guide including a plate spaced apart from the label and a plurality of guide arms for guiding said label, said guide arms having ends each of which are contacted by said label as said label is guided between said printing unit and said cutting unit, said guide arms being of a material to which the adhesive on said adhesive side of said label does not stick thereby for said label to move between said printing unit and said cutting unit without sticking to said second guide and jamming the apparatus, and said plate including a plurality of spaced slots for mounting said guide arms to said plate.

2. The apparatus of claim 1 wherein the path of said label extends parallel to said plate.

3. The apparatus of claim 1 wherein each of said guide arms is generally L-shaped with a guide portion of each said arm extending through one of said slots.

4. The apparatus of claim 3 wherein each said guide arm further includes a second portion which is attached to said plate to hold said guide arm in place.

* * * * *